US006276898B1

(12) United States Patent
Elliott

(10) Patent No.: US 6,276,898 B1
(45) Date of Patent: Aug. 21, 2001

(54) VARIABLE PITCH MARINE PROPELLER

(76) Inventor: Morris C. Elliott, 11723 Norino Dr., Whittier, CA (US) 90601

( * ) Notice: Subject to any disclaimer, the term of this patent is extended or adjusted under 35 U.S.C. 154(b) by 0 days.

(21) Appl. No.: 09/418,957

(22) Filed: Oct. 14, 1999

Related U.S. Application Data

(63) Continuation-in-part of application No. 08/949,021, filed on Oct. 10, 1997, now Pat. No. 5,967,750.

(51) Int. Cl.[7] ..... B63H 3/00
(52) U.S. Cl. ..... 416/162; 416/166; 440/50
(58) Field of Search ..... 416/93 R, 93 A, 416/159, 169, 166, 162, 205, 208, 244 B; 440/49, 50; 60/534, 545

(56) References Cited

U.S. PATENT DOCUMENTS 3,796,514 * 3/1974 DuFrene ..... 416/124
5,527,153 * 6/1996 Bernhardt ..... 416/46
5,908,284 * 6/1999 Lin ..... 416/134
6,158,960 * 12/2000 Marsi ..... 416/43

FOREIGN PATENT DOCUMENTS

404056697 * 2/1992 (JP) .

* cited by examiner

*Primary Examiner*—Edward K. Look
*Assistant Examiner*—Ninh Nguyen
(74) *Attorney, Agent, or Firm*—Sheldon & Mak

(57) ABSTRACT

A variable-pitch marine propeller system has a propeller unit for mounting on a drive shaft, and a power unit including a stationary annular hydraulic cylinder for operating the propeller unit, a hydraulic remote control unit being fluid-coupled to the power unit. The propeller unit is provided with a shear pin assembly that is serviceable for replacing sheared pins without removing the propeller unit from the drive shaft. An annular piston of the hydraulic cylinder is coupled to a ring-shaped actuator yoke by a roller thrust bearing, the actuator yoke axially displacing a mating yoke of the propeller unit with which the actuator yoke is allowed to rotate. The piston operates in a sealed environment for the exclusion of water from the separately sealed surfaces of the cylinder itself. In one configuration, the propeller unit is replaceable without disturbing the sealed environment of the annular piston. The control unit includes a hydraulic control cylinder that is operated by a threaded piston rod. In a preferred configuration of the control unit, the rod is a ballscrew having an antifriction ballnut fastened to the control piston, and the control unit can be provided with a position encoder. The control unit can also be motorized and equipped with a clutch control knob for manual operation with the motor decoupled.

19 Claims, 7 Drawing Sheets

VARIABLE PITCH MARINE PROPELLER

This application is a continuation-in-part of Ser. No. 08/949,021 filed Oct. 10, 1997 now U.S. Pat. No. 5,967,750.

BACKGROUND

The present invention relates to propeller propulsion devices, and more particularly to variable pitch propeller devices for marine craft such as inboard and outboard pleasure boats, yachts and fishing boats.

Variable pitch aircraft propellers are well known, implementations including hydraulic actuators being disclosed, for example, in U.S. Pat. Nos. 2,425,261 to Murphy et al., 2,554,611 to Biermann, and 4,362,467 to the present inventor. The '467 patent, which is incorporated herein by this reference, discloses a mounting flange for mounting to the propeller shaft flange of an engine, a hub for pivotally supporting a plurality of blades on respective radial axes, and a stationary annular hydraulic cylinder and piston between the mounting flange and the hub, the piston being connected by a yoke and transverse pin to a longitudinal rack member that engages respective pinions of the blades to rotate same through a wide angle of approximately 90°.

Typical marine propeller installations include a rearwardly extending propeller shaft on which is mounted a one-piece propeller having an annular hub portion, the shaft extending through the hub and threadingly engaging a retainer nut. The hub is secured against rotation relative to the shaft such as by splined engagement or by one or more keys or shear pins.

The aircraft propeller implementation of the '467 patent, while having certain advantages including the stationary annular hydraulic cylinder, is unsuitable for use in typical marine applications for a number of reasons. For example:

1. The shaft interferes with placement and movement of the yoke pin and the rack member;

2. The rear of the hub, including a biasing spring mechanism therein, interferes with access to the nut whereby the hub would be secured to the shaft;

3. The hub and blades would be difficult to remove for servicing and/or replacement in case of damage by underwater hazards; and 4. The device would be subject to water damage in that hub is unsealed, and the piston seals would have to operate in a wet environment.

A further problem exhibited in the prior art relates to the need in marine applications for means to decouple the propeller in case of impact with potentially damaging foreign objects such as submerged rocks and logs. Typically, such a device couples the propeller to it's shaft by a "shear pin" that transmits normal driving torques but which is supposed to sever when the propeller strikes an obstacle. The shear pins of the prior art are difficult to replace in that the propeller must be removed from the shaft, typically with significant difficulty resulting from interference with jagged edges of the severed shear pin. Moreover, the difficulty with which the propeller is removed significantly increases the risk of it's being dropped into the water.

Thus there is a need for a variable pitch marine propeller that is effective for providing a wide angular range, that is compatible with existing fixed-pitch installations, that is easy to service, repair, and replace, and is resistant to water damage.

SUMMARY

The present invention meets this need by providing a modular variable pitch system configuration of propeller and stationary annular actuator for facilitating assembly, servicing and replacement particularly of parts most subject to damage by under-water hazards. The system is adapted for marine drives including a driven shaft having a locating surface, a torque-transmitting surface, and a retainer surface for engagement by a retaining device, the shaft extending from a base structure such as a drive housing. In one aspect of the invention, a propeller system having an easily serviceable torque limiting safety device includes a propeller unit having a hub rotatably mountable on the driven shaft for supporting a plurality of radially projecting blade members, a hub passage being formed in structure rigidly fixed relative to the hub; a sleeve member mountable on the driven shaft in engagement with the torque-transmitting surface and having a sleeve passage formed in one wall thereof, the sleeve passage being alignable with the hub passage for placement of a shear pin in engagement with the hub and sleeve passages; and a retainer member removably mountable in covering relation to at least one of the hub and sleeve passages when the shear pin is placed therein for retaining the shear pin, whereby torque is transmittable from the sleeve member through the shear pin to the hub until fracture of the shear pin in response to occurrence of a predetermined limiting torque, allowing the hub to rotate relative to the driven shaft, and when the retainer member is removed from covering the at least one of the hub and sleeve passages, the shear pin is removable from the passages for replacement without the hub being removed from the driven shaft. The system can be assembled with the shear pin located in engagement with the hub and sleeve passages, the retainer member being removably fastened in fixed relation to the hub.

Preferably the blade members are movably supported relative to the hub, a yoke member being axially movable relative to the hub in response to a power actuator, and means for moving the blade members in variable pitch relation to the hub in response to axial movement of the yoke member. The means for moving can include each blade member being rotatably mounted on a respective radially extending axis of the hub and having a pinion fixedly connected thereto, and the propeller yoke including axially extending rack elements engaging corresponding ones of the pinions.

The power actuator can include an annular hydraulic cylinder rotatably supportable relative to the spindle and having a fluid port and means for preventing rotation of the cylinder by mechanical coupling to the base structure, an actuator piston sealingly axially movable in the hydraulic cylinder for coupling fluid flow relative to the port, a thrust bearing for transmitting axial force between the actuator piston and the yoke member, whereby the yoke member moves axially relative to the spindle in response to fluid flow into the port, and the spindle, the hub, and the yoke member can be rotated by the shaft while the cylinder and the piston are being prevented from rotation by the coupling to the base.

The shaft is operable submerged in water, and the system can further include power unit seal means for excluding water from the actuator piston and the thrust bearing. Preferably the propeller unit is separable from the drive shaft without disturbing the power actuator.

The yoke member can be a propeller yoke and the power actuator can be in a power unit, the power unit further including a spindle for coupling to the shaft and rotation therewith, a piston yoke for contacting the propeller yoke, a first thrust bearing for transmitting axial force between the spindle and the cylinder, and a second thrust bearing for transmitting axial force between the piston and the piston yoke. The piston yoke moves axially relative to the spindle in response to fluid flow into the port, and the spindle and the piston yoke can be rotated by the shaft while the cylinder and the piston are being prevented from rotation by the coupling to the base. The power unit is locatable adjacent the propeller unit opposite the retainer device whereby the axial force is transmitted from the locating surface, through the power unit to the propeller yoke by the piston yoke, and through the means for moving and the hub to the retainer device. The axial movement of the propeller yoke causes the blade members to move from a first position toward a second position relative to the hub in response to the fluid flow into the port.

Preferably the spindle is adapted for being clamped between the locating surface and the hub by the retainer device. Preferably the system further includes an antifriction radial bearing for concentrically supporting the cylinder relative to the spindle.

The system can further include a hydraulic control unit being fluid-connectable to the fluid port and including a primary hydraulic cylinder, a control piston sealingly axially movable in the primary cylinder, a lead screw rotatably supported in the housing and having an antifriction nut assembled thereto, the nut being threadingly engaged with the lead screw by means of a plurality of rollingly interposed elements, the nut being rigidly connected to the control cylinder, the lead screw being axially supported within the housing by an antifriction thrust bearing for advancing the control piston at high mechanical advantage in response to rotation of the lead screw, whereby the pitch of the blades is adjustable in response to rotation of the lead screw. The control unit preferably includes an encoder coupled to the lead screw for signaling positions thereof to an external device. The control unit can further include a control motor coupled to the lead screw for driving same to an externally determined setpoint position in response to the encoder. The control unit can further include a manual control knob and a clutch coupled between the control knob and the lead screw and the control motor for selectively decoupling the control motor from the lead screw, the lead screw being manually operable by the control knob when the control motor is in a decoupled condition.

The system can further include means for biasing the piston against the fluid flow into the port for retraction of the piston relative to the cylinder when fluid is allowed to flow out of the port, in response to reduced fluid pressure, the blade members correspondingly moving toward the first position. The biasing means can include a spring for urging the propeller yoke axially toward the piston yoke relative to the hub.

The means for preventing rotation can include the fluid port being formed for engagement by a hydraulic fitting having a conduit extending therefrom, and a mechanical connection between the conduit and the base. The system can include two of the blade members that project from opposite sides of the hub, or three of the blade members that project in equally spaced relation to the hub.

DRAWINGS

These and other features, aspects, and advantages of the present invention will become better understood with reference to the following description, appended claims, and accompanying drawings, where:

DESCRIPTION

Figure 1:
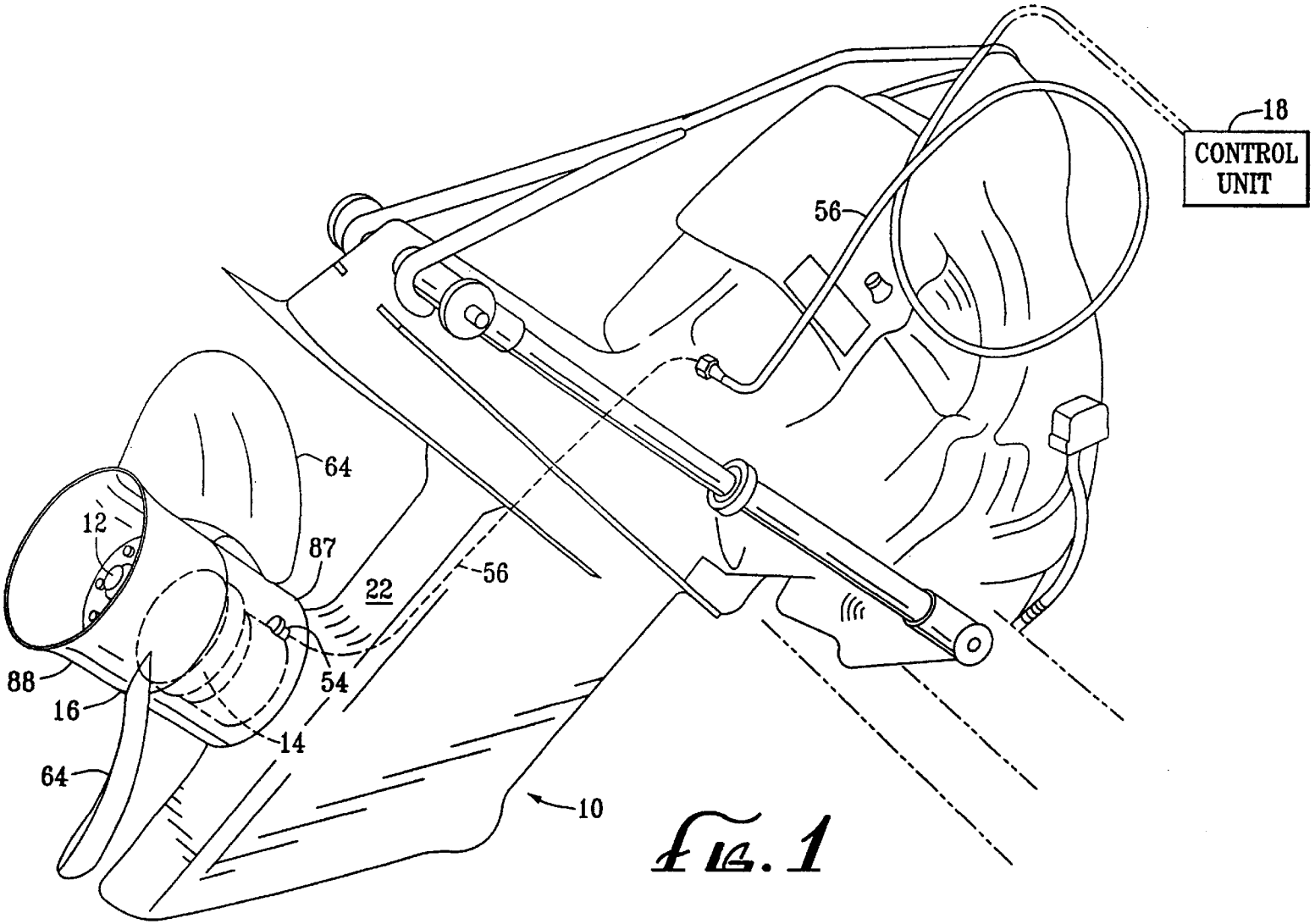
FIG. 1 is a perspective view of a variable pitch propeller system according to the present invention, the system being installed on an existing outboard watercraft engine.

The present invention is directed to a variable pitch propeller system that is particularly effective in marine environments. With reference to FIGS. 1–5 of the drawings, a propeller system 10 for a shaft drive 12 includes a power unit 14, a propeller unit 16, and a control unit 18 being fluid-connected to the power unit as described below. The shaft drive 12 is representative of typical existing hardware, having a propeller shaft 20 rearwardly extending from a base structure 22 that can be a hull member or an outboard drive housing. The shaft 20 is formed with an engagement surface 24 having a tapered portion 25 for locating a conventional propeller (not shown), a cylindrical portion 26, splined portion 27 for transmitting torque to the conventional propeller, and a threaded portion 28 for engagement by a retainer nut 29 by which the conventional propeller is clamped against the tapered portion 25. The power unit 14 of the propeller system 10 includes a spindle 30 for coupling to the shaft 20 by location on the tapered portion 25 and the cylindrical portion 26 of the engagement surface, optionally by using an adapter sleeve 31 for facilitating use of a singly configured spindle 30 with a plurality of differently configured propeller shafts 20. An annular hydraulic cylinder 32 is supported in concentric relation to the spindle 30, the cylinder 32 having a piston 34 being axially slidable in sealed relation therewith, the cylinder 32 also having a port member 36 fixedly extending therefrom. The port member 36 has a threaded fluid port 37 formed therein for receiving a suitable hydraulic fluid as further described below, the port 37 being fluid-connected to the cylinder 32 by a port passage 38 for axially displacing the piston 34. The port member 36 can be integrally formed with the cylinder 32, or fastened thereto as shown in the drawings, an O-ring 39 sealing the passage 38.

The power unit 14 also includes a piston yoke 40 for operating the propeller unit 16 as described below, and antifriction bearings for transmitting axial forces while permitting rotation of the spindle 30 and the piston yoke 40 with the shaft 20 while the hydraulic cylinder 32 and the piston 34 are restrained from rotation. A first needle or roller thrust bearing 42 is located between the spindle 30 and the hydraulic cylinder 32; a second such thrust bearing 44 is located between the piston 34 and the piston yoke 40, for transmitting axial force to the piston yoke 40; and a radial needle bearing 46 is located within the cylinder 32 for engagement by the cylindrical portion 26 of the propeller shaft 20 (preferably via the adapter sleeve 31 as discussed above) to thereby maintain concentricity of the cylinder 32 with the shaft 20.

The piston 34 is provided with respective outside and inside ring seals 48 and 49 that sealingly contact corresponding finished surfaces of the hydraulic cylinder 32 in a conventional manner. According to the present invention, the power unit has further seals for excluding water and foreign matter from the surfaces contacted by the ring seals 48 and 49. In one exemplary configuration and as shown in FIG. 3, a rotary first seal 50 is supported by the cylinder 32 for sealingly contacting a front portion of the spindle 30; a rotary second seal 51 is supported by an inside surface of the piston yoke 40 for sealingly contacting a rear portion of the spindle 30; and an axial third seal 52 is supported by the cylinder 32 for sealingly contacting an outside surface of the piston yoke 40.

Figure 3:
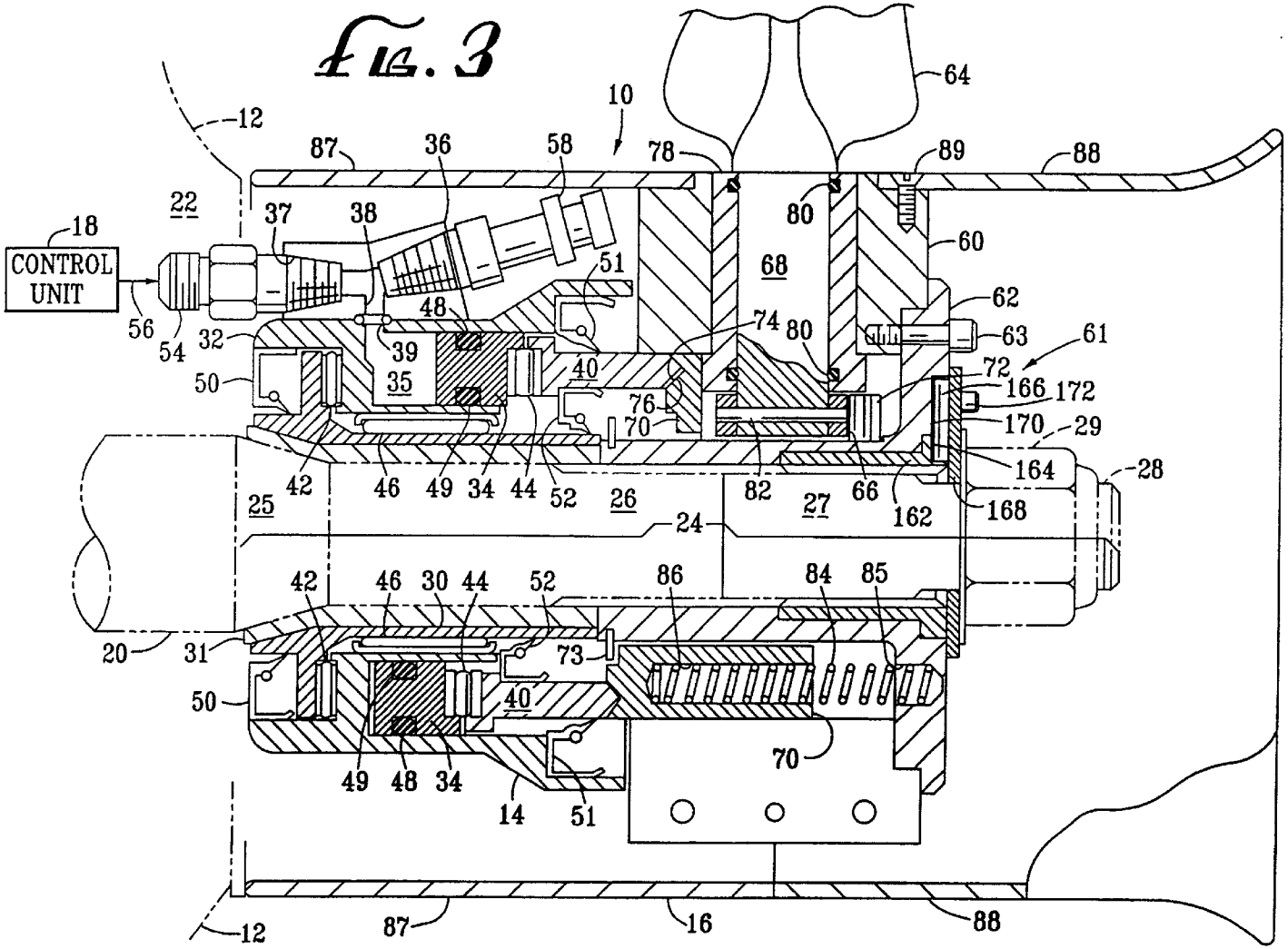
FIG. 3 is a fragmentary lateral sectional view of the propeller system of FIG. 1 on line 3—3 in FIG. 2.

The threaded port 37 is provided with a feed fitting 54 by which the control unit 18 is fluid-connected to the power unit 14 through a suitable conduit 56 (schematically shown in FIG. 3). The port member 36 (alone or in combination with the fitting 54) provides a mechanical connection point for restraining the hydraulic cylinder 32 from rotating with the spindle 30. For example, rotational restraint can be achieved by the fitting 54 extending between opposite walls of the base member 22, or by anchoring the conduit 56 to the base member 22 proximate the fitting 54. The port member 36 is also formed for supporting a bleed valve 58 in fluid communication with the passage 38, by which air can be bled from control unit 18.

Figure 2:
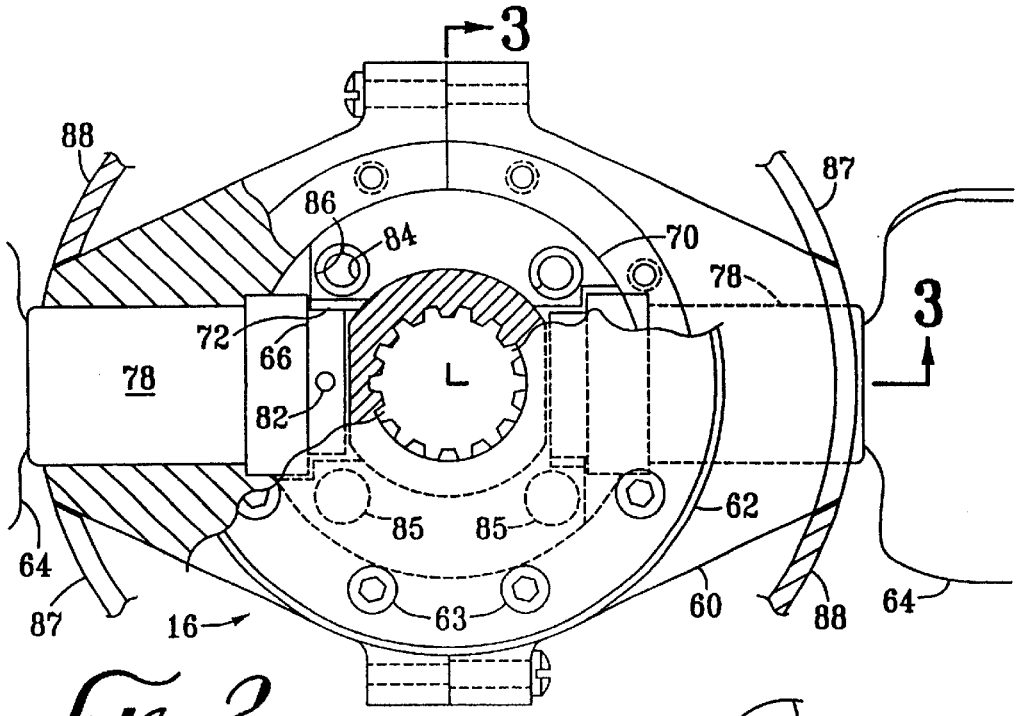
FIG. 2 is an axial sectional view of a propeller unit portion of the propeller system of FIG. 1.

The propeller unit 16 includes a hub 60, a flange member 62 for coupling the hub 60, preferably through a torque limiting safety device, designated shear pin assembly 61 and further described below, to the splined portion 27 of the shaft 20, the flange member 62 being affixed to the hub 60 by a plurality of flange fasteners 63. A plurality of radially extending blade members 64 are rotatably supported by the hub 60, each blade member 64 having a pinion 66 on a stem portion 68 thereof. The propeller unit 16 also includes a ring-shaped rack member 70 having a plurality of radial rack sections 72 formed thereon for engaging corresponding ones of the pinions 66, the rack member 70 being axially slidably supported on a portion of the flange member 62 that extends within the hub 60. A retainer ring 73 is assembled to the flange member 60 proximate a front extremity thereof for limiting forward movement of the rack member 70. The rack member 70 is formed with an annular groove 74 for engaging a complementary annular projection 76 of the piston yoke 40, the groove 74 and the projection 76 acting to help maintain concentricity of the yoke 40 and rack member 70 relative to the hub 60 and the flange member 62. Each of the blade members 64 is supported in the hub 60 by a respective bearing member 78 that rotatably engages the corresponding stem portion 68, each bearing member 78 having a spaced pair of internal O rings 80 for sealingly retaining a suitable lubricant such as grease therebetween. The blade members 64 are axially secured in the bearing members 78 by the pinions 66 being pinned to the stem portions using respective pin members 82. Inward portions of the bearing members 78 are formed as enlarged flange portions 79 for retention by counterbored portions of the hub 60 as best shown in FIG. 2, thereby securing the blade members 64 against outward movement from the hub 60. Inward movement of the blade members 64 (and the bearings 78) is blocked by respective flattened portions of the flange member 62 contacting end extremities of the stem portions 68 as shown in FIGS. 2 and 3, the flattened portions also providing clearance for the pinions 66. Rotational alignment of the rack member 70 relative to the hub 60 for maintaining geared engagement of the pinions 66 by the rack sections 72 is maintained by the flange portions 79 of the bearing members 78 contacting the rack member 70 opposite respective ones of the rack sections 72.

The extension of flange member 62 through the hub 60 axially contacts the spindle 30 of the power unit 14, the spindle 30 and the flange member 62 being clamped between the tapered portion 25 of the shaft 20 and the retainer nut 29. The propeller unit 16 is removable from the shaft 20 (following removal of the retainer nut 29) without disturbing the power unit 14. Advantageously, the sealing of the combination of the hydraulic cylinder 32 and the piston 34 by the seals 50, 51 and 52 remains intact during removal and replacement of the propeller unit 16.

Axial movement of the piston yoke 40 in response to pressure fluid flow into the hydraulic cylinder 32 produces corresponding axial movement of the rack member 70, and proportional rotation of the blade members 64 relative to the hub 60, the rotation resulting from geared engagement of the pinions 66 with the radial rack sections 72 of the rack member 70. The propeller unit 16 is also provided with a plurality of compression springs 84 for oppositely rotating the blade members 64 while returning the rack member 70, the yoke 40 and the piston 34 toward the passage 38 when fluid pressure is released therefrom. Opposite ends of each compression spring 84 are located in respective flange and yoke cavities 85 and 86 that are formed in the flange member 62 and the rack member 70. The retainer ring 73 sets the maximum forward angular orientation or pitch of the blade members 64, and prevents axial movement of the rack member 70 out of the hub 60, thereby keeping the propeller unit 60 intact when it is removed from the shaft 20. In a preferred implementation, the maximum forward pitch at the tips of the blade members 64 is approximately 54 degrees. (A standard fixed-pitch 140 HP propeller has a tip angle of approximately 44 degrees.) At the opposite extremity of the axial movement, a maximum reverse pitch of 25 degrees is attained. The compression springs 84 provide a total of approximately 300 pounds of biasing against movement of the piston 34. Additionally (or alternatively), the blade members 64 are formed to provide rotational torque reactions against the piston 34 in response to advancement in a water (or air) fluidic medium.

Figure 4:
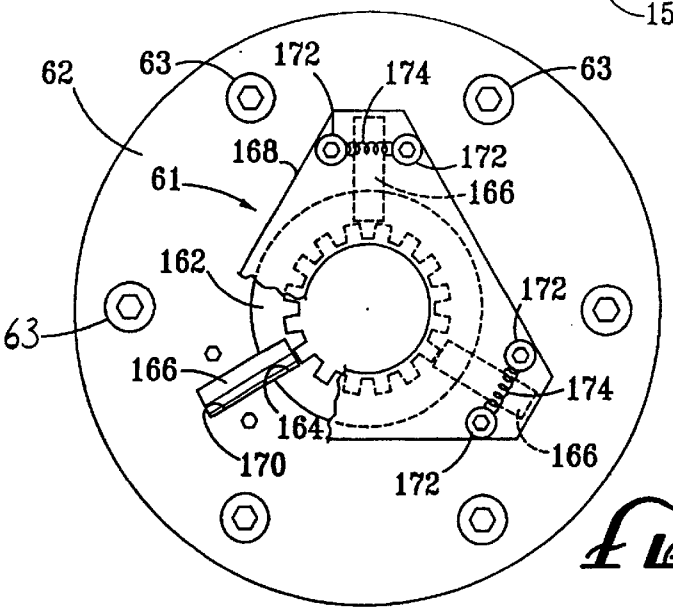
FIG. 4 is a rear view of the propeller unit of FIG. 2.

The preferred shear pin assembly 61, introduced above, includes an internally splined bushing 162 as best shown in FIG. 3, the bushing engaging the splined portion 27 of the propeller shaft 20 and being freely rotatable in the flange member 62. The bushing 162 has radially oriented slots 164 formed therein for receiving end portions of respective shear pins 166. The flange member 62 is also formed with radially oriented slots, designated 170, for receiving outwardly extending portions of the shear pins 166, the pins transmitting a predetermined maximum torque between the flange member 62 and the bushing 162. Excessive torque, such as might be caused by blade members 64 striking a submerged tree stump or the like, results in shearing of the pins 166 so that the hub of the propeller unit 16 can freely rotate relative to the propeller shaft 20, thereby avoiding damage to other components of the system 10. For this purpose, the material and dimensions of the shear pins 166 is selected for fracture at a predetermined fail-safe torque. It will be understood that the number of shear pins to be employed is also variable within the scope of the present invention. A thrust plate 168 is interposed between the retainer nut 29 and the flange member 62 for retaining the pins 166 in the slots and 170, the thrust plate being fastened to the flange member 62 by a plurality of cap screws 172. As shown in FIG. 4, pairs of the cap screws 172 are located on opposite sides of respective shear pins 166 for convenient securing by suitable safety wire 174.

As further shown in FIGS. 1–3, the propeller unit 16 is provided with tubular front and rear shrouds 88 that promote smooth fluid flow from the base member 22 and past the blade members 64. Each of the shrouds 87 and 88 is appropriately notched to clear the bearing members 78 of the blade members 64, being fastened to the hub 60 by a plurality of shroud fasteners 89. Also, the hub 60 is segmented for facilitating fabrication thereof and for facilitating assembly of the propeller unit 16. The exemplary configuration of the propeller unit shown in FIGS. 1 and 2 has a pair of the blade members 64 extending radially from opposite sides of the shaft 20, the blade members 64 being controllably rotatable within the radially oriented bearings 78 as described above for altering the pitch of the blade members. As further described below, the propeller unit 16 can be provided with three or more of the blade members.

Figure 5:
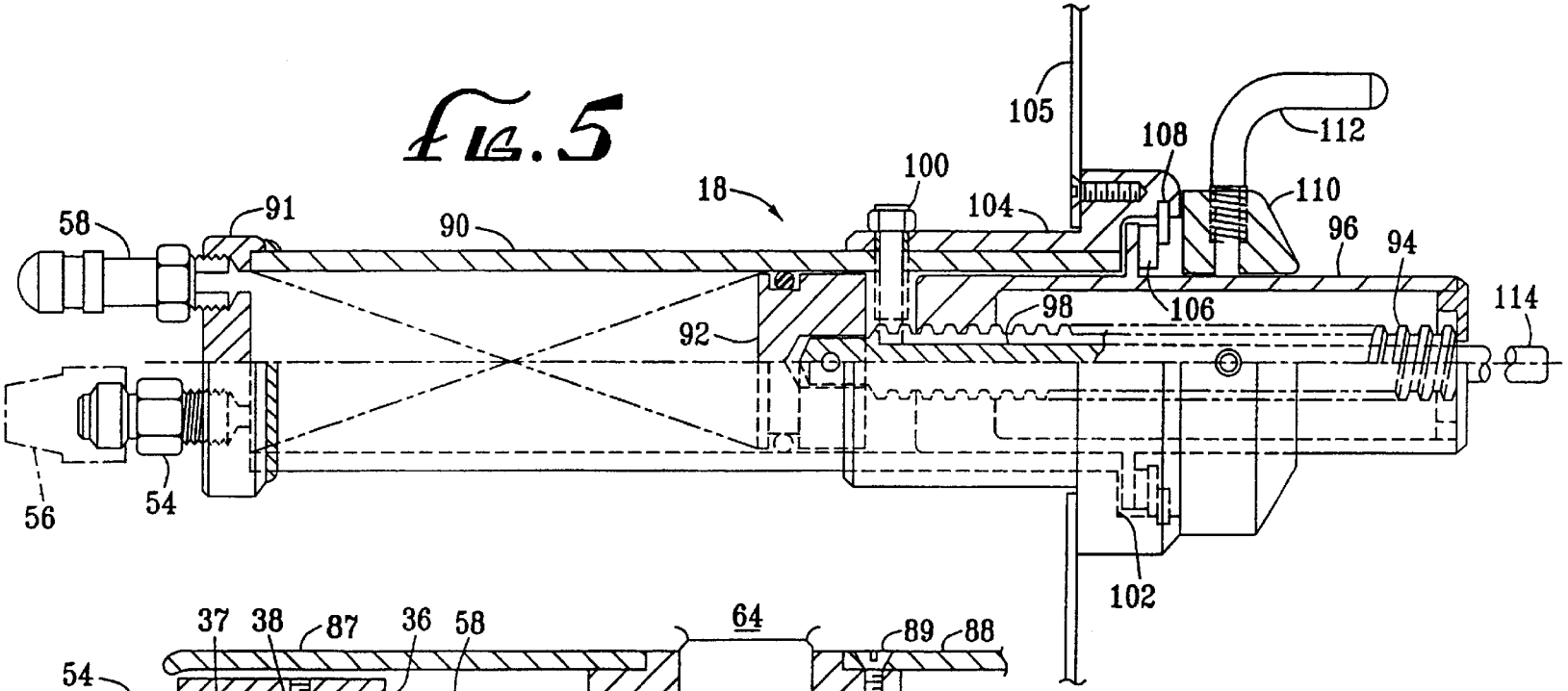
FIG. 5 is a lateral sectional view of a control unit portion the propeller system of FIG. 1.

An exemplary configuration of the control unit 18, depicted in FIG. 5, corresponds generally to a control device as described in the above-referenced U.S. Pat. No. 4,362,467. The control unit 18 includes a hydraulic control cylinder 90 having a control piston 92 therein and having a threaded piston rod 94 extending therefrom. A rotatably supported barrel member 96 threadingly engages the piston rod for axially positioning the piston 92 in the cylinder 90. The piston rod 94 has a longitudinal groove 98 formed therein, a key pin 100 slidably engaging the groove 98 for preventing rotation of the rod 94. The cylinder 90 has a head portion 91 opposite the piston rod 94, counterparts of the fitting 54 and the bleed valve 58 being mounted on the head portion 91 in fluid communication with the cylinder 90, the conduit 56 being connected to the fitting 54.

The barrel member 96 has an outwardly extending flange portion 102, one face of which rotatably engages an anchor sleeve 104 of the cylinder 90, a roller thrust bearing 106 that is retained in the anchor sleeve 104 by a conventional retainer ring 108. The sleeve 104 is adapted for mounting through a stationary member, such as a control panel 105. A handle collar 110 is fixably mounted on the barrel member 96 and having an L-shaped crank member 112 rigidly extending therefrom for facilitating manual rotation of the barrel member 96. The thrust bearing 106 axially supports the barrel member during forced advancement of the control piston 92 toward the fitting 54, movement in the opposite direction being generally unopposed in that the springs 84 of the propeller unit 16 are effective for driving the blade members 64, the yokes 40 and 70, and the piston 34 to produce fluid flow into the control cylinder 90 during retraction of the control piston 92. The piston rod 94 has a stem extremity 114 that projects from the barrel member 96 for indicating relative positions of the piston 92, thereby providing visual indications of propeller pitch settings of the system 10. The stem extremity 114 can have colored striping for designating particular pitch ranges such as forward (high and low pitch), neutral, and reverse.

Figure 6:
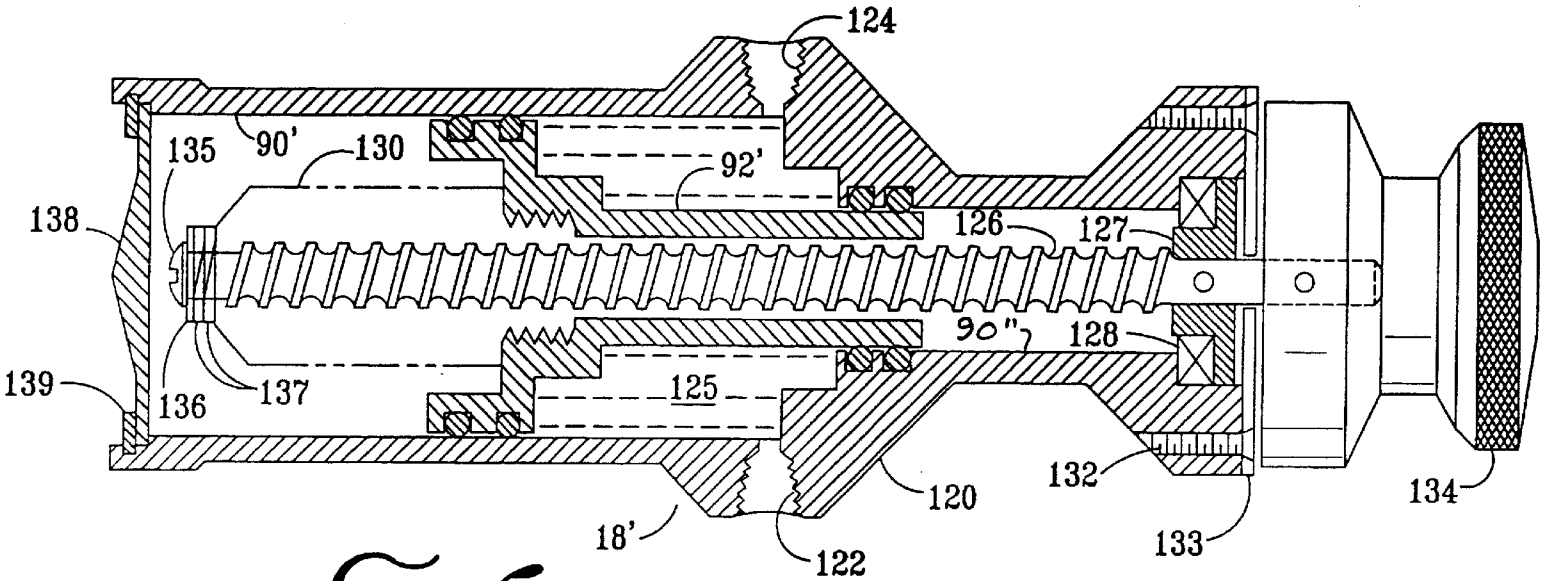
FIG. 6 is a sectional view as in FIG. 5, showing an alternative configuration of the control unit.

With further reference to FIG. 6, an alternative configuration of the control unit, designated 18', includes a housing 120, a counterpart of the control cylinder, designated 90' being formed at one end thereof, a smaller counterpart of the cylinder, designated 90" being axially spaced from the cylinder 90'. A counterpart of the piston, designated 92', has sealed sliding engagement with the cylinders 90' and 90", the housing 120 also having respective feed and bleed ports 122 and 124 formed in opposite walls thereof for correspondingly receiving the fitting 54 and the bleed valve 58 as described above in connection with FIG. 5. The ports 122 and 124 are in fluid communication with a fluid chamber 125, a volume thereof varying by an axial travel distance of the piston 92' multiplied by that portion of the area of the cylinder 90' that is outside of the cylinder 90". A ballscrew 126 is rotatably supported in the housing by a thrust bushing 127, a suitable antifriction thrust bearing 128 being interposed between the bushing and the housing 120. The ballscrew 126 has a ballnut 130 assembled thereto, the ballnut being rigidly connected to the piston 92' by threaded engagement therewith for advancing the piston 92' toward the bearing 128 against fluid pressure in the chamber 125 in response to rotation of the ballscrew 126. If necessary or desired, suitable means such as an axially oriented pin can be used for preventing rotation of the piston 92' relative to the housing 120, such pin being anchored to one of the housing 120 and the piston and having sliding engagement with the other. The ballscrew 126 may be made from a length of commercially available stock, designated R-308 (⅜ inch diameter×0.125 lead), a suitable ballnut for use as the ballnut 130 being available as No. 8103-448-003 (R-0308 without flange or wiper) from Warner Electric Brake & Clutch Co. of South Deloit, Ill.

The housing 122 has fastener openings 132 for mounting to suitable structure such as the control panel 105 (not shown in FIG. 6) and/or a thrust plate 133. A control knob 134 is fixedly mounted to the ballscrew 126 for advancing the piston 92' at high mechanical advantage and low frictional resistance. A stop screw 135 with an accompanying large pattern stop washer 136 prevents movement of the ballnut 130 beyond the free end of the ballscrew 126. Also, one or more calibration washers 137 are interposed between the ballnut 130 and the washer 136 for adjusting a full-scale hydraulic volume displacement of the control unit 18' to match that of the propeller unit 16. An end plate 138 and a retainer ring 139 therefor are included in the control unit 18' for excluding dust and other contamination from the ballnut 130 and from otherwise exposed portions of the cylinder 90'.

Figure 7:
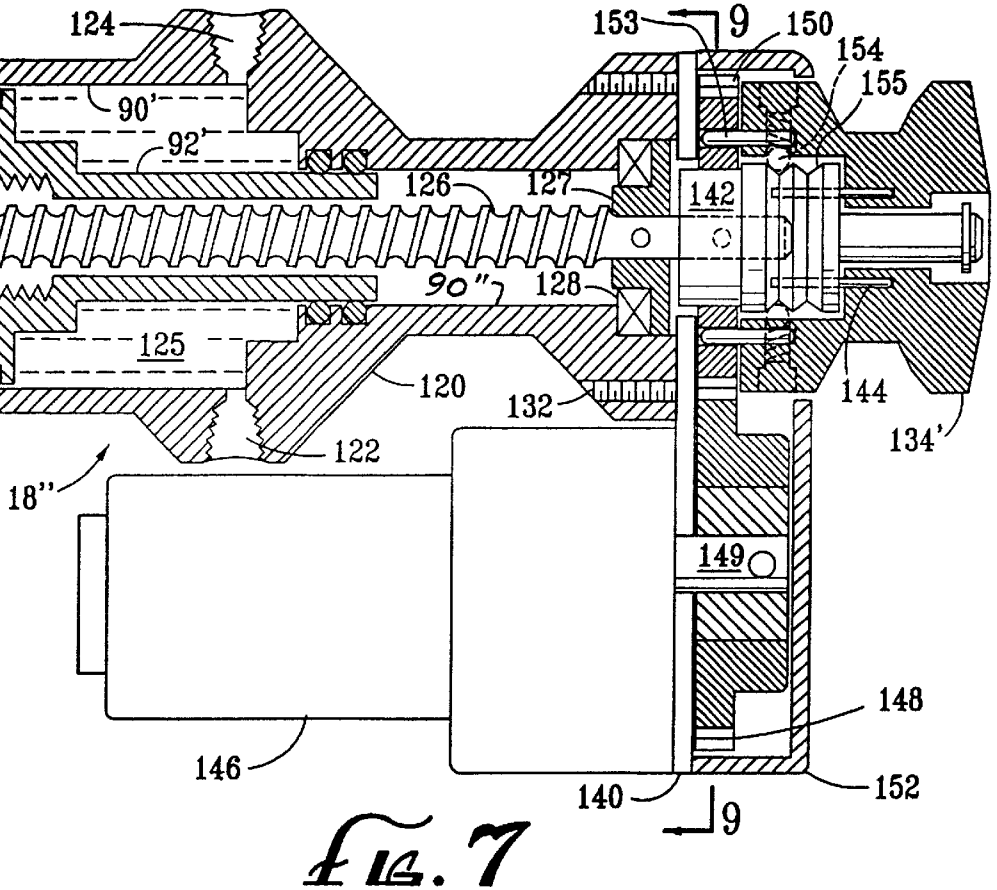
FIG. 7 is a lateral sectional view showing an alternative configuration of the control unit portion of FIG. 6, in a manual mode condition.
Figure 9:
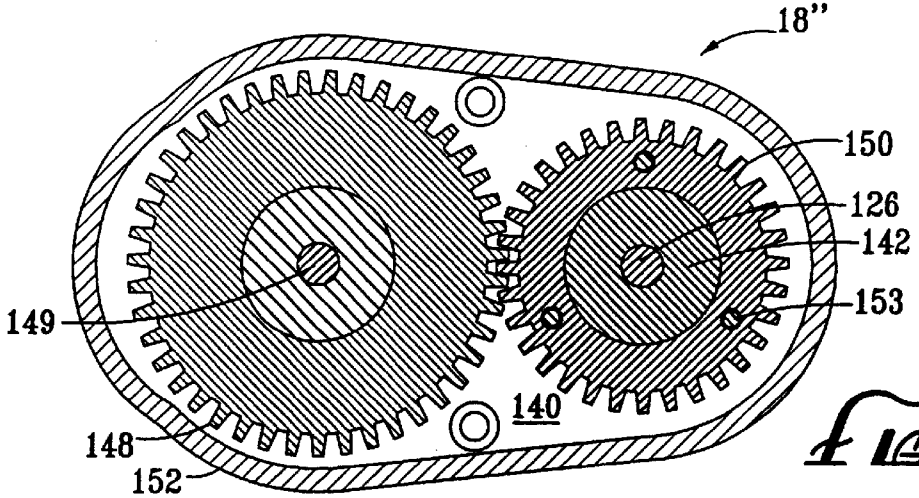
FIG. 9 is a sectional view on line 9—9 of FIG. 7.
Figure 8:
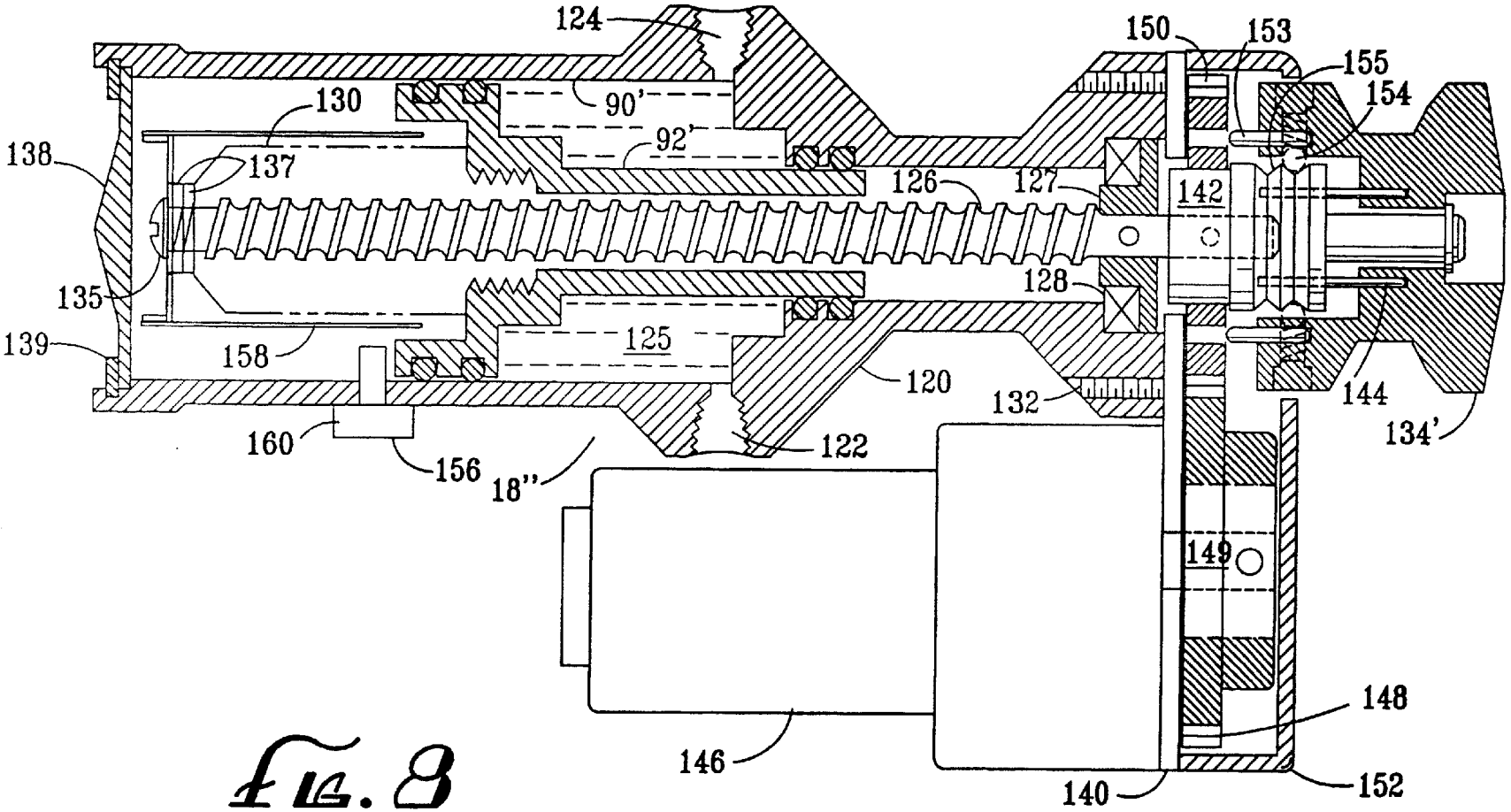
FIG. 8 is a sectional view as in FIG. 7, showing control unit of FIG. 7, in a powered mode condition.

With further reference to FIGS. 7–9, an alternative configuration of the control unit 18', designated 18", is selectively operable in both manual and powered modes as described herein. A motor plate 140 is mounted to the housing 120 in place of the thrust plate 133, and a clutch bushing 142 is substituted for the control knob 134 on the ballscrew 126. A counterpart of the control knob, designated clutch knob 134', is slidably supported on the clutch bushing 142, being coupled for rotation therewith by a pair of axially oriented dowel pins 144. A control motor 146 is mounted to the motor plate in parallel spaced relation to the ballscrew 126, a drive gear 148 being mounted to an output shaft 149 of the motor and engaging a driven gear 150 that is freely rotatably supported on the clutch bushing 142 when the clutch knob is in an axially withdrawn first position relative to the bushing 142 as shown in FIG. 8. Thus, when the knob 134' is in the first position, the motor 146 is effectively disengaged, the control unit 18" being in a manual mode and operable in like manner as the control unit 18' of FIG. 6, described above. The clutch knob 134' projects through a gear cover 152 that is fastened to the motor plate 140, enclosing the gears 148 and 150.

A pair of coupling pins 153 project from the clutch knob 134' for engaging the driven gear 150 when the knob is in an axially inwardly displaced second position relative to the bushing 142 as shown in FIG. 7. Thus, when the knob 134' is in the second position, operation of the control unit 18" is in a powered mode in response to suitable electrical signals to the control motor 146. In the first position of the knob, the pins 153 are withdrawn clear of the driven gear 150 as shown in FIG. 8. The clutch knob 134' is provided with an angularly spaced plurality of springballs 154 that detent in respective axially spaced grooves 155 of the clutch bushing 142 for releasably holding the knob 134' in the corresponding first and second positions thereof.

The motor 146 is connected in a conventional control circuit (not shown) that is responsive to operator input and feedback from a rotary position encoder 156 that includes an encoder drum 158 that is mounted to the ballscrew 126 in place of the stop washer 137, and a sensor unit 160 that projects through the housing 120 for signaling the passage of suitable reflective indicia on the drum 158 that can be axially extending lines according to conventional incremental encoder practice. It will be understood that an absolute position reference is obtainable by operating the motor 146 at low power until the ballnut 130 reaches a physical stop, such as the calibration washers 138, also according to conventional practice. Thus the motor 146 can drive the ballscrew 126 to an externally determined setpoint in response to the encoder 156. A 12 volt DC gear reduction motor suitable for use as the motor 146 is available as No. 455A104-2 from TRW Globe Motor Division, Dayton, Ohio.

Figure 10:
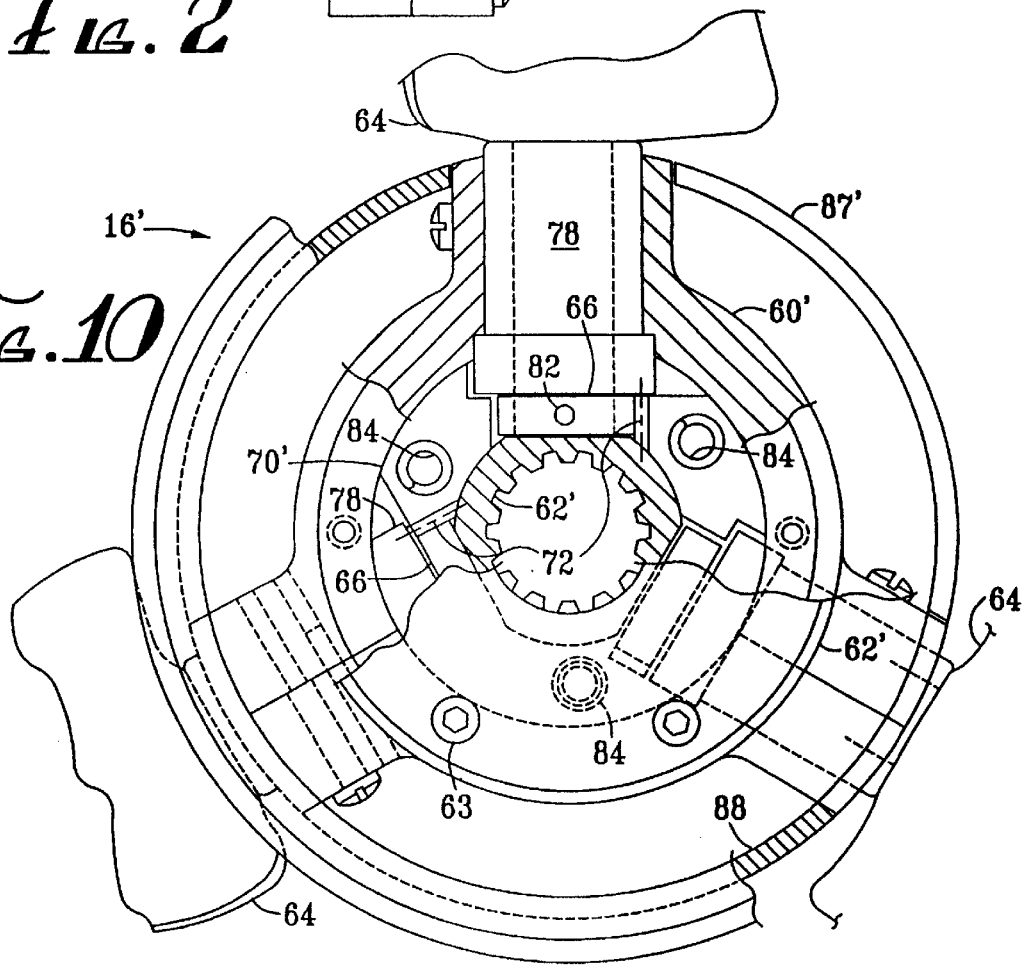
FIG. 10 is a sectional view as in FIG. 2, showing an alternative configuration thereof.

With further reference to FIG. 10, an alternative configuration of the propeller unit, designated 16', has three equally spaced counterparts of the blade members 64, the pinions, and the bearings 78. A counterpart of the hub, designated 60', is formed as three segments that are joined at the bearings 78 for facilitating fabrication and assembly as described above relative to the configuration of FIGS. 1–4. A counterpart of the flange member, designated 62', has three equally spaced flattened regions that provide clearance for the pinions 66 and for blocking the inward movement of the blade members 64 as described above in connection with FIGS. 2 and 3. It will be appreciated that the bearings 78 can be formed integrally with the hub 60' (of bronze, for example, when salt water operation is contemplated). Also, a row of bearing balls can be interposed between the pinions 66 and the bearings 78 (whether same are formed integrally with the hub or not), a suitable concave raceway being formed in one or both of the pinion 66 and the bearing 78 for maintaining the balls in a captured condition.

Figure 11:
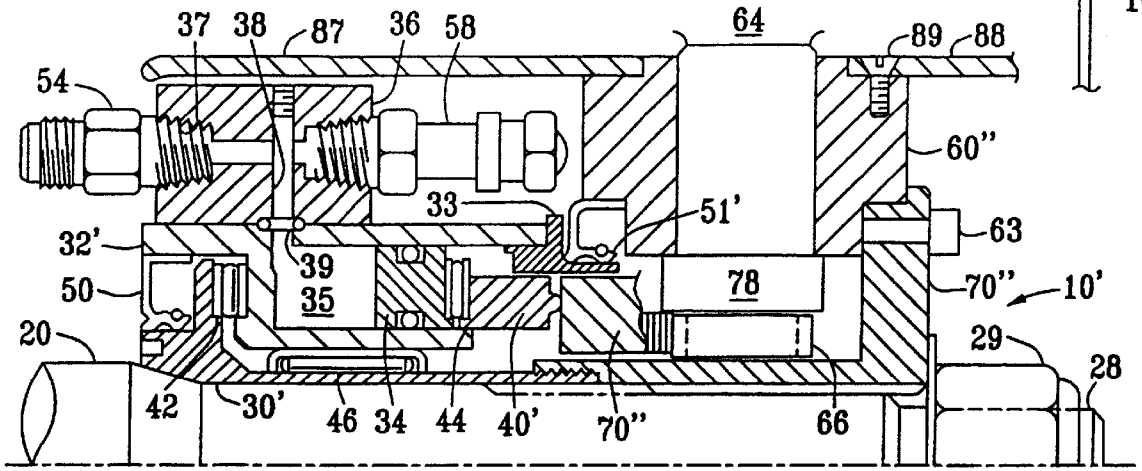
FIG. 11 is a lateral sectional view showing another alternative configuration of the propeller unit of FIG. 2.

With further reference to FIG. 11, another alternative configuration of the system 10 has a counterpart of the rotary second seal, designated 51', supported on a counterpart of the hub, designated 60". The seal 51' sealingly contacts a cylinder extension 33 that projects from a counterpart of the annular hydraulic cylinder, designated 32'. The cylinder extension advantageously permits the sealing contact to be at reduced diameter for correspondingly reduced frictional drag by the seal 51', and for permitting a more compact seal to be utilized than otherwise. As further shown in FIG. 11, the flange member 62" can be formed for being fixedly connected to a counterpart of the spindle, designated 30', such as by threaded engagement that preferably forms a water-tight connection. The power unit 14 and the propeller unit 16 being thus connected, they would be installed and removed from the shaft 20 as a single unit, thereby maintaining the sealed environment of the piston 34. It will be understood that the configuration of FIG. 11 can, and preferably does, include the shear pin assembly of FIGS. 3 and 4.

The system 10 of the present invention thus avoids rotating oil seals that are subject to leakage and have short life spans. The O rings 48 and 49 operating in the stationary hydraulic cylinder 32 have minimum travel; and no rotation, and the needle thrust bearing 44 next to the piston 34 and having high loading capacity and requiring very little lubrication, allows the propeller blade members 64, which are rotating, to be positioned by the stationary hydraulic cylinder. The blade members 64 can be feathered, a particularly advantageous feature for sail boats. For bass fishing, by being able to lower the pitch of the propeller blades, sufficiently low boat speeds are practical that an extra trolling motor is not needed.

Although the present invention has been described in considerable detail with reference to certain preferred versions thereof, other versions are possible. For example, the hydraulic cylinder 32 can be rigidly anchored to the base member 22, the first thrust bearing 42 not being required. More than one outboard or inboard engine can be provided with counterparts of the system 10, using a single control unit 18 (having dual hydraulic cylinders), even if the propellers operate in opposite directions. Also, larger marine propellers may be positioned with the control unit 18 utilizing an engine-driven hydraulic pump and having a pressure regulator. Further, the central opening of the thrust plate 168 can be enlarged such that the nut 29 (and its associated washer, if any) bears directly against the splined bushing 162 for permitting free rotation of the flange member 62 in the event that the shear pins 166 are fractured. Moreover, the control unit 18' of FIG. 6 can be equipped with the position encoder 156 of FIGS. 7 and 8 for driving a suitable electronic or electromechanical indicator display. Alternatively, a graduated thimble can be mounted to the ballscrew 126, projecting through the end plate 138 for providing a direct visual indication of the position of the control piston 92'. Therefore, the spirit and scope of the appended claims should not necessarily be limited to the description of the preferred versions contained herein.

What is claimed is:

1. A propeller system for a driven shaft having a locating surface, a torque-transmitting surface, and a retainer surface for engagement by a retaining device, the shaft extending from a base structure, the system comprising:

(a) a propeller unit having a hub supporting a plurality of radially projecting blade members in movable relation to the hub, the hub being rotatably mountable on the driven shaft between the locating surface and the retainer surface, a hub passage being formed in structure rigidly fixed relative to the hub;

(b) a sleeve member mountable on the driven shaft in engagement with the torque-transmitting surface and having a sleeve passage formed in one wall thereof, the sleeve passage being alignable with the hub passage for placement of a shear pin in engagement with the hub and sleeve passages; and (c) a retainer member removably mountable in covering relation to at least one of the hub and sleeve passages when the shear pin is placed therein for retaining the shear pin;

(d) a yoke member axially movable relative to the hub in response to a power actuator; and (e) means for moving the blade members in variable pitch relation to the hub in response to axial movement of the yoke member, whereby torque is transmittable from the sleeve member through the shear pin to the hub until fracture of the shear pin in response to occurrence of a predetermined limiting torque, allowing the hub to rotate relative to the driven shaft, and when the retainer member is removed from covering the at least one of the hub and sleeve passages, the shear pin is removable from the passages for replacement without the hub being removed from the driven shaft.

2. The propeller system of claim 1, wherein the shear pin is located in engagement with the hub and sleeve passages and the retainer member is removably fastened in fixed relation to the hub.

3. The propeller system of claim 1, wherein the means for moving comprises each blade member being rotatably mounted on a respective radially extending axis of the hub and having a pinion fixedly connected thereto, and the propeller yoke including axially extending rack elements engaging corresponding ones of the pinions.

4. The propeller system of claim 1 including the power actuator, comprising an annular hydraulic cylinder rotatably supportable concentric with the spindle and having a fluid port and means for preventing rotation of the cylinder by mechanical coupling to the base structure, an actuator piston sealingly axially movable in the hydraulic cylinder for coupling fluid flow relative to the port, a thrust bearing for transmitting axial force between the actuator piston and the yoke member, whereby the yoke member moves axially relative to the spindle in response to fluid flow into the port, and the spindle, the hub, and the yoke member can be rotated by the shaft while the cylinder and the piston are being prevented from rotation by the coupling to the base.

5. The propeller system of claim 4, wherein the driven shaft is operable submerged in water, the system further comprising seal means for excluding water from contacting the actuator piston and the thrust bearing.

6. The propeller system of claim 4, wherein the propeller unit is separable from the drive shaft without disturbing the power actuator.

7. The propeller system of claim 6, wherein the yoke member is a propeller yoke and the power actuator is in a power unit, the power unit further comprising a spindle for coupling to the shaft and rotation therewith, a piston yoke for contacting the propeller yoke, a first thrust bearing for transmitting axial force between the spindle and the cylinder, and a second thrust bearing for transmitting axial force between the piston and the piston yoke, whereby the piston yoke moves axially relative to the spindle in response to fluid flow into the port, and the spindle and the piston yoke can be rotated by the shaft while the cylinder and the piston are being prevented from rotation by the coupling to the base, the power unit being locatable adjacent the propeller unit opposite the retainer device whereby the axial force is transmitted from the locating surface, through the power unit to the propeller yoke by axial facing contact with the piston yoke, and through the means for moving and the hub to the retainer device, the blade members moving from a first position toward a second position relative to the hub in response to the fluid flow into the port.

8. The propeller system of claim 7, wherein the spindle is adapted for being clamped between the locating surface and the hub by the retainer device.

9. The propeller system of claim 7, further comprising an antifriction radial bearing for concentrically supporting the cylinder relative to the spindle.

10. The propeller system of claim 4 further comprising a hydraulic control unit connectable to the power actuator for controllably advancing the actuator piston, comprising:

(a) a housing having a primary hydraulic cylinder formed therein;

(b) a control piston sealingly slidably engaging the primary hydraulic cylinder for forming a closed fluid cavity of variable volume, the fluid cavity being in fluid communication with the fluid port when the control unit is connected to the actuator; and (c) a lead screw rotatably supported in the housing and having an antifriction nut assembled thereto, the nut being threadingly engaged with the lead screw by means of a plurality of rollingly interposed elements, the nut being rigidly connected to the control cylinder, the lead screw being axially supported within the housing by an antifriction thrust bearing for advancing the control piston at high mechanical advantage in response to rotation of the lead screw, whereby the pitch of the blades is adjustable in response to rotation of the lead screw.

11. The propeller system of claim 10, wherein the control unit further comprises an encoder coupled to the lead screw for signaling positions thereof to an external device.

12. The propeller system of claim 11, further comprising a control motor coupled to the lead screw for driving same to an externally determined setpoint position in response to the encoder.

13. The propeller system of claim 12, further comprising a manual control knob and a clutch coupled between the control knob and the lead screw and the control motor for selectively decoupling the control motor from the lead screw, the lead screw being manually operable by the control knob when the control motor is in a decoupled condition.

14. The propeller system of claim 4, further comprising means for biasing the actuator piston against the fluid flow into the port for retraction of the piston relative to the cylinder when fluid is allowed to flow out of the port, in response to reduced fluid pressure, the blade members correspondingly moving toward the first position.

15. The propeller system of claim 14, wherein the means for biasing comprises a spring for urging the propeller yoke axially toward the piston yoke relative to the hub.

16. The propeller system of claim 4, wherein the means for preventing rotation comprises the fluid port being formed for engagement by a hydraulic fitting having a conduit extending therefrom, and a mechanical connection between the conduit and the base.

17. The propeller system of claim 1, comprising two of the blade members, the blade members projecting from opposite sides of the hub.

18. The propeller system of claim 1, comprising three of the blade members, the blade members projecting in equally spaced relation to the hub.

19. A modular variable pitch propeller system for a driven shaft having a locating surface, a torque-transmitting surface, and a retainer surface for engagement by a retaining device, the shaft extending from a base structure and being operable submerged in water, the system comprising:

(a) a power unit having a spindle for coupling to the shaft and rotation therewith, an annular hydraulic cylinder rotatably supportable relative to the spindle and having a fluid port and means for preventing rotation of the cylinder by mechanical coupling to the base structure, a piston slidably engaging the cylinder in sealed relation therewith and coupling fluid flow relative to the port with axial movement of the piston, a piston yoke axially movably supported relative to the spindle, a first thrust bearing for transmitting axial force between the spindle and the cylinder, a second thrust bearing for transmitting axial force between the piston and the piston yoke, and power unit seal means including a rotary first seal between the spindle and the cylinder, an axial second seal between the spindle and the piston yoke, and a third seal between the cylinder and the piston yoke for excluding water from the piston and the thrust bearings, whereby the piston yoke moves axially relative to the spindle in response to fluid flow into the port, and the spindle and the piston yoke can be rotated by the shaft while the cylinder and the piston are being prevented from rotation by the coupling to the base;

(b) a propeller unit having a hub rotatably mounted on the shaft, a plurality of blade members radially projecting from the hub, each blade member being rotatably mounted on a respective radially extending axis of the hub and having a pinion fixedly connected thereto, a propeller yoke axially movable relative to the hub, the propeller yoke supporting axially extending rack elements engaging corresponding ones of the pinions for moving the blade members relative to the hub in response to axial movement of the propeller yoke, and a spring for urging the propeller yoke axially toward the piston yoke relative to the hub for biasing the piston against the fluid flow into the port for retraction of the piston relative to the cylinder when fluid is allowed to flow out of the port, in response to reduced fluid pressure, the blade members correspondingly moving toward the first position, and a torque-limiting device for coupling the hub to the torque-transmitting surface of the shaft including a collar for engaging the torque-transmitting surface and having a radially oriented collar slot formed therein, a shear pin engaging the collar slot and projecting radially therefrom, a hub slot being formed in structure rigidly supported relative to the hub and having a projecting portion of the shear pin engaged therewith, and a cover member removably covering the collar and hub slots for service access to the shear pin, the power unit being locatable adjacent the propeller unit opposite the retainer device with the spindle clamped between the locating surface and the hub by the retainer device, the axial force being transmitted from the locating surface, through the power unit to the propeller yoke by axial facing contact with the piston yoke, and through the means for moving and the hub to the retainer device, the blade members moving from a first position toward a second position relative to the hub in response to the fluid flow into the port, access to the shear pin being available by removal of the cover member without requiring removal of the propeller unit from the shaft; and (c) a control device comprising a hydraulic control cylinder having a control port, a control piston sealingly axially movable in the control cylinder, a conduit fluid-connecting the control port to the fluid port of the annular hydraulic cylinder, and a mechanism for adjustably positioning the control piston and holding the control piston against hydraulic pressure being used for operating the power unit.

* * * * *